United States Patent [19]

Moore

[11] Patent Number: 4,558,505

[45] Date of Patent: Dec. 17, 1985

[54] METHOD OF MAKING WEIGHTED METAL GOLF CLUB HEAD

[76] Inventor: Wildey J. Moore, P.O. Box 4046, New Windsor, N.Y. 12550

[21] Appl. No.: 631,590

[22] Filed: Jul. 17, 1984

[51] Int. Cl.[4] ..... B22D 11/126; B22D 19/00

[52] U.S. Cl. ..... 29/527.6; 164/98; 164/112

[58] Field of Search ..... 29/527.6; 164/112, 98, 164/99, 100, 101, 102, 103, 104, 105

[56] References Cited

U.S. PATENT DOCUMENTS 2,084,247 6/1937 Dockray et al. ..... 164/112

*Primary Examiner*—Howard N. Goldberg
*Assistant Examiner*—Vernon K. Rising
*Attorney, Agent, or Firm*—McCormick, Paulding & Huber

[57] ABSTRACT

A metal golf club head is provided, by an investment casting process, having an accurately positioned weighting insert of heavy metal rigidly embedded in and surrounded by the principle metal of the head with the presence of the insert, if desired, being entirely or substantially undetectable from a visual inspection of the finished head.

7 Claims, 9 Drawing Figures

METHOD OF MAKING WEIGHTED METAL GOLF CLUB HEAD

BACKGROUND OF THE INVENTION

This invention relates to the manufacture of metal golf club heads, and deals more particularly with a process for making a metal head having one or more weighting inserts of heavy metal embedded in the metal defining the head's external shape.

It is well known, as shown for example by prior U.S. Pat. Nos. 3,995,865; 4,076,254; and 4,326,326; to apply weighting inserts to golf club heads to achieve certain desired objectives of balance, moment of inertia, center of impact, etc., in the finished head, and many different schemes for attaching one or more weights to a head have been proposed in the past.

The general object of this invention is to provide an improved method for making a weighted metal golf club head, particularly a method which is easy and economical to practice, resulting in a finished head wherein the weighting insert is rigidly embedded in the surrounding metal of the head so as to avoid any possibility of its becoming loose and whereby the presence of the weighting insert in the finished head may be made entirely or at least substantially undetectable by visual inspection of the finished head.

A further object of the invention is to provide a process for making a golf club head which is flexible as to the number and shape of inserts to be included in the finished head thereby allowing wide choice in the design of the shape and weight characteristics of the head.

Other objects and advantages of the invention will be apparent from the detailed description and from the accompanying drawings and the claims.

SUMMARY OF THE INVENTION

The invention resides in a method for making a weighted metal golf club head, such as an "iron" head, wherein a weighting insert is first introduced into a wax pattern mold so as to be embedded in the wax pattern and to have one or more tab portions extending outwardly from the pattern. The pattern is then invested in a suitable liquid investment material with the investment material subsequently being hardened and cured and the wax burned out to create an investment mold with the weighting insert being located within the mold cavity and supported in such position by the tab portion or portions being embedded in the investment material. Molten metal is then cast into the mold cavity, surrounding the insert and conforming to the shape of the mold cavity to define a golf club head. The mold is broken to remove the head and the head is then finished with the finishing process including the cutting off of the outwardly extending tab portion or portions of the weighting insert.

DETAILED DESCRIPTION OF THE PREFERRED EMBODIMENT

Figure 1:
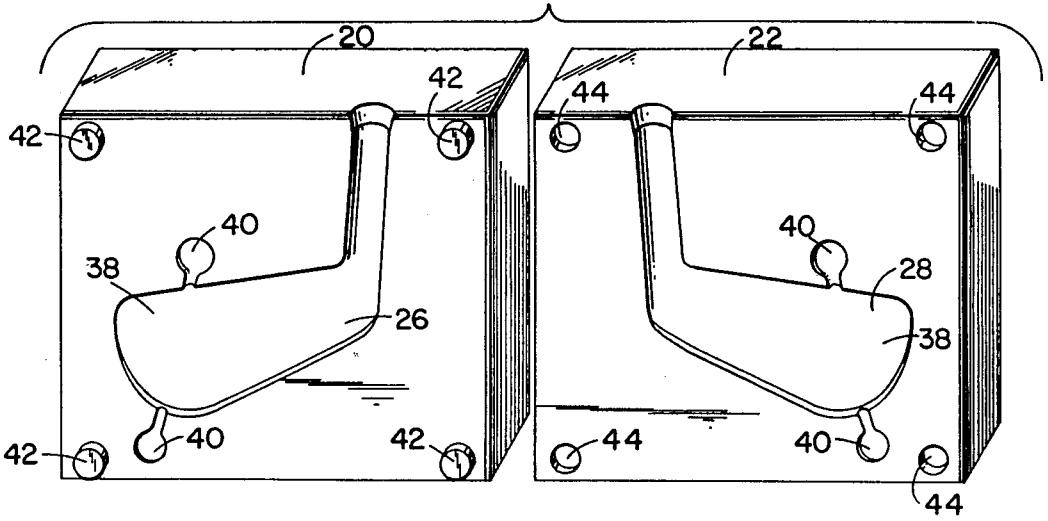
FIG. 1 is a perspective view showing the two halves of a wax pattern mold such as may be used in practicing the invention.

The process of the invention is basically an investment casting one and in accordance with it a wax pattern is first made having one or more weighting inserts embedded in it with each insert having at least one tab portion extending outwardly from the pattern with the tab portion or portions serving to support the insert both in the formation of the wax pattern and in the subsequent casting of the molten metal. The shape of the insert may vary widely as may other factors such as the number of tab portions on each insert, the number of inserts provided for each golf club head and the location of the insert with respect to the shape of the head. The material of the insert may also vary, but in the preferred case the insert material is a heavy metal such as tungsten or spent uranium. In the drawings and description which follows the invention is disclosed in connection with the making of a golf club head of the "iron" variety having a single weighted insert of particular shape, but it should be understood that this description is intended to be by way of example only.

Figure 2:
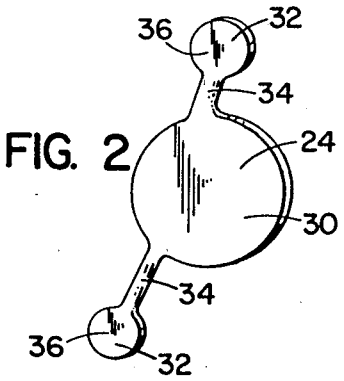
FIG. 2 is a perspective view of a weighting insert which may be used in conjunction with the wax pattern mold of FIG. 1.

Referring to the drawings, FIG. 1 shows the two halves 20 and 22 of a metal wax pattern mold for use with a weighting insert 24 as shown in FIG. 2. The two mold halves when closed, as shown in FIG. 4, define a mold cavity a part 26 of which is included in the mold half 20 and the remaining part 28 of which is contained in the mold half 22, as seen in FIG. 1.

The insert 24, as seen in FIG. 2, includes a main body 30 and two outwardly extending tab portions 32, 32 with each tab portion including a stem 34, of relatively small cross section, and a flattened head 36.

Figure 4:
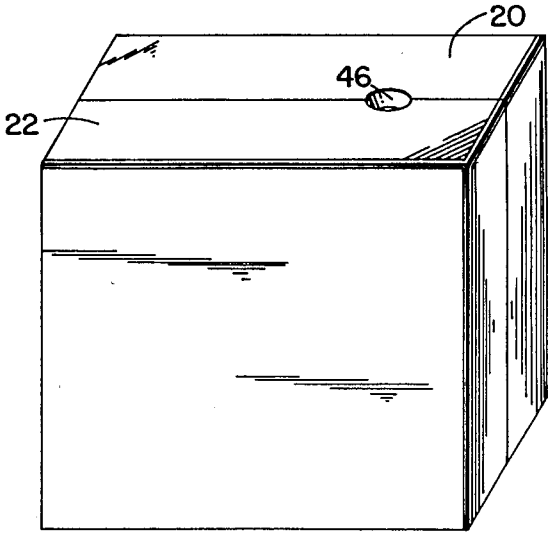
FIG. 4 is a perspective view showing the two halves of the mold of FIG. 1 closed upon themselves in readiness for the introduction of wax.

The mold cavity defined by the cavities 26 and 28 of the mold halves 20 and 22, when the mold halves are closed as shown in FIG. 4, includes a main cavity having generally the shape of the desired golf club head and auxiliary cavities for receiving the tab portions of an insert 24. In FIG. 1 such main cavity is indicated at 38 and such auxiliary cavities are indicated at 40 in both the mold halves 20 and 22 although it will be understood that such main cavity and auxiliary cavities are not complete until the two mold halves are closed as shown in FIG. 4.

Figure 3:
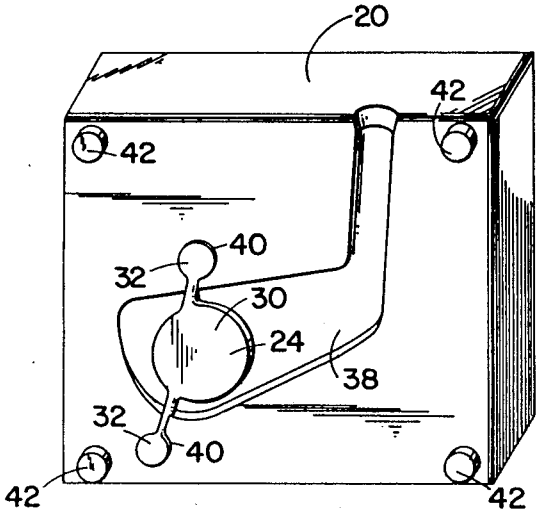
FIG. 3 is a perspective view showing one half of the mold of FIG. 1 with the weighting insert of FIG. 2 positioned in it.

With the mold halves open as shown in FIG. 1 an insert 24 is placed into one of the mold halves. Such step is shown, for example, in FIG. 3 wherein an insert 24 is shown positioned in the mold half 20. From this it can be seen that the auxiliary cavities 40, 40 are so located that they receive the two tab portions 32, 32 of the insert and cause the main body 30 of the insert to be positioned in the main cavity 38 in spaced relations to the walls of that cavity. Further, when the mold half 22 is closed onto the mold half 20 the tab portions 32, 32 are held fixed to the mold halves to retain the insert in its position relative to the main cavity 38 while the subsequent introduction of molten wax takes place. As is conventional one of the mold halves 20 includes a number of locating pins or lugs 42, 42 received by openings 44, 44 in the other mold half 22 to cause the two cavity portions 26 and 28 to accurately register with one another when the mold halves are closed as in FIG. 4.

With the mold halves closed as shown in FIG. 4 and with an insert 24 included in the closed mold halves, molten wax is introduced into the mold through the gate 46, as by pouring or injection, and it will be understood that as the molten wax flows into the mold cavity it will surround the insert 24 and fill the cavity 38, so that after the introduction of the wax is completed, and after the wax is allowed to cool and thereby harden, the mold halves 20 and 22 may be opened and the wax pattern removed.

Figure 5:
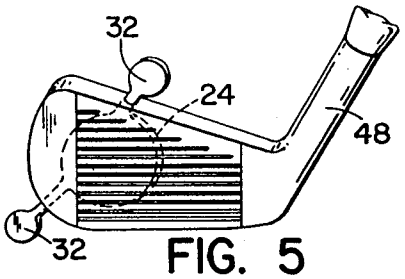
FIG. 5 is a perspective view showing a wax pattern produced by the wax pattern mold of FIG. 1.

FIG. 5 shows a wax pattern 48 as removed from the mold of FIG. 4. This pattern has generally the shape of the desired golf club head and includes the insert 24 embedded in the wax material of the pattern with the two tab portions 32, 32 extending outwardly from the wax body.

Figure 6:
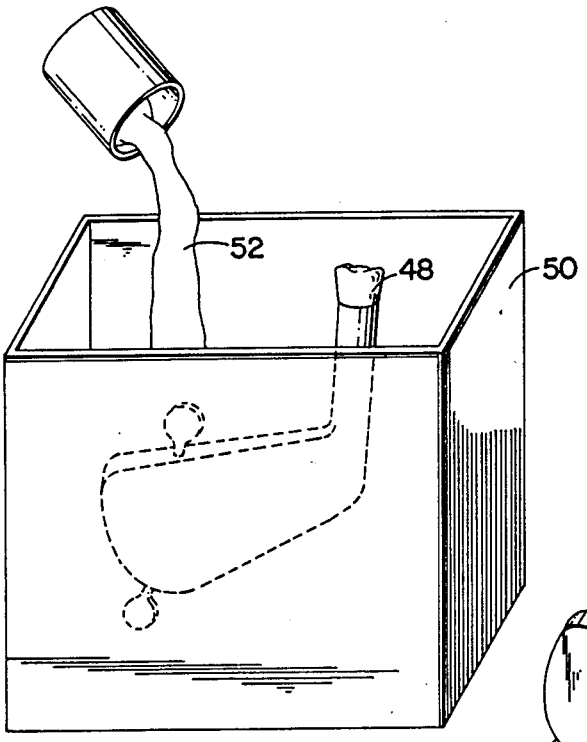
FIG. 6 is a schematic perspective view showing the investing of the wax pattern of FIG. 5.
Figure 7:
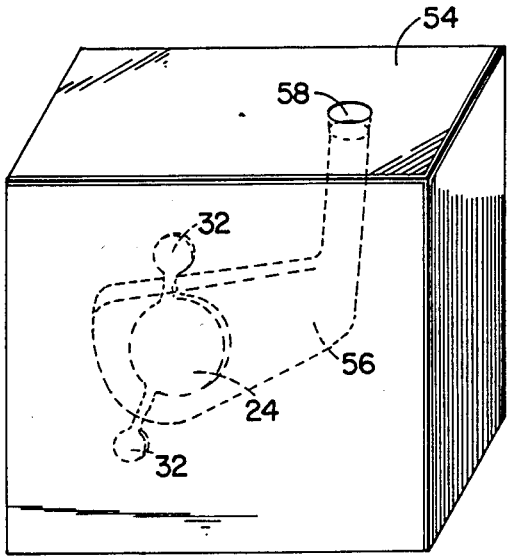
FIG. 7 is a perspective view showing the investment mold resulting from the investing step of FIG. 6.

The wax pattern of FIG. 5 is now used to form an investment mold. In doing this, as shown in FIG. 6, the pattern is placed into an open topped container 50 and a liquid investment material 52 is poured into the container to fill the container and to completely envelop or invest the wax pattern 48. The investment material is then allowed to solidify, the solidified material is removed from the container 50 and the material is then placed in an oven or other heating device to cure the investment material and burn out the wax of the pattern 48, the result being an investment mold 54 such as shown in FIG. 7 including a mold cavity 56 having positioned in it the insert 24. The insert 24 is so positioned and supported in the cavity 56 by its two tab portions 32, 32, which are now embedded in the investment material of the mold 54.

Molten metal is now poured into the investment mold 54 through its gate 58. Various different metals may be used for this casting step depending on the desired characteristics of the resulting golf club head. Preferred materials, however, are either 17-4PN stainless steel or benic - benic being a well known alloy of berillium, nickel and chromium.

Of course, as the molten metal is poured into the investment mold 54 it will surround the insert 24 and fill the cavity 56. After this metal cools and solidifies the mold 54 may be broken and the casting removed from it. Such casting is shown at 60 in FIG. 8 and is in the form of an unfinished golf club head wherein the weighting insert 24 is entirely embedded in the external shape defining material of the head except for the two outwardly extending tab portions 32, 32.

Figure 8:
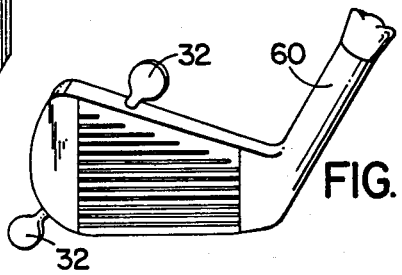
FIG. 8 is a perspective view showing an unfinished golf club head resulting from use of the investment mold of FIG. 7.
Figure 9:
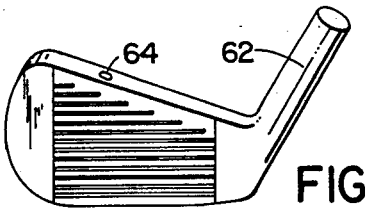
FIG. 9 is a perspective view showing the golf club head of FIG. 8 after finishing.

The unfinished head 60 of FIG. 8 is now finished to produce a finished head 62 as shown in FIG. 9. This finishing includes a cutting off of the tab portions 32, 32 flush to the surface of the sourrounding metal so that the finished head 62 will on its exterior surface include only two small areas, one of which is shown at 64, evidencing the presence of the weighting insert. If desired, as a further part of the finishing process the head 62 may be plated in which case the areas 64, 64 will be covered with the plating material rendering the presence of the weighting insert entirely undetectable by visual inspection. On the other hand, the areas 64, 64 may be left unplated and serve as intentional indicators of the presence of the weighting insert.

I claim:

1. A method for making a weighted metal golf club head, said method comprising:

providing a weighting insert made of a heavy metal and consisting of a main body and at least one tab portion extending outwardly from said body, providing a multi-part mold which when closed defines a main cavity having generally the shape of a golf club head and at least one auxiliary cavity for receiving said at least one tab of said insert, said at least one auxiliary cavity being so arranged that when the at least one tab of a weighted insert is placed therein the main body of the insert is located within said main cavity of said mold in spaced relation to the walls of said main cavity, while said mold is in an open condition placing an insert therein by positioning its at least one tab in said at least one auxiliary cavity, closing said mold, introducing melted wax into said main cavity of said mold and letting said wax solidify to form a wax pattern of a golf club head having said insert embedded therein with said at least one tab extending outwardly from said pattern, removing said wax pattern from said mold, creating an investment mold from said wax pattern by investing said pattern in liquid investment material, letting said investment material solidify and then heating said solidified material to cure it and melt out the wax of said pattern, the investment mold so created having a cavity in which said insert is supported by said at least one tab which at least one tab is embedded in the investment material of said mold, casting molten metal into said mold to fill its cavity and surround said main body of said insert, allowing said metal to solidify, breaking said investment mold to remove the golf club head defined by said solidified metal, which head has a portion of said at least one tab of said insert extending outwardly therefrom, and cutting said outwardly extending portion of said at least one tab from said golf club head.

2. The method of producing a golf club head as defined in claim 1 further characterized by said weighting insert being made of tungsten.

3. The method of producing a golf club head as defined in claim 1 further characterized by said weighting insert being made of inert uranium.

4. The method of producing a golf club head as defined in claim 1 further characterized by said weighting insert having two tabs extending outwardly from its main body and said multi-part mold having likewise two auxiliary cavities for respectively receiving said two tabs of said insert.

5. The method of producing a golf club head as defined in claim 1 further characterized by said step of cutting said outwardly extending portion of said at least one tab from said golf club head being so performed that the exposed surface of said tab produced by said cutting is flush with a surface of the surrounding metal defining said golf club head, and subsequently plating said golf club head so that said exposed surface of said tab and the adjacent surrounding surface of the other metal defining said golf club head are covered with the plating material.

6. The method of producing a golf club head as defined in claim 1 further characterized by said molten metal being stainless steel.

7. The method of producing a golf club head as defined in claim 1 further characterized by said molten metal being benic.

* * * * *